US011421481B2

(12) United States Patent
Chambers et al.

(10) Patent No.: US 11,421,481 B2
(45) Date of Patent: Aug. 23, 2022

(54) ROTARY STEERABLE TOOL WITH DUMP VALVE

(71) Applicant: HALLIBURTON ENERGY SERVICES, INC., Houston, TX (US)

(72) Inventors: Larry DeLynn Chambers, Kingwood, TX (US); Neelesh V. Deolalikar, Houston, TX (US); Michael Dewayne Finke, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 540 days.

(21) Appl. No.: 16/328,577

(22) PCT Filed: Feb. 19, 2018

(86) PCT No.: PCT/US2018/018598
§ 371 (c)(1),
(2) Date: Feb. 26, 2019

(87) PCT Pub. No.: WO2019/160559
PCT Pub. Date: Aug. 22, 2019

(65) Prior Publication Data
US 2021/0324682 A1 Oct. 21, 2021

(51) Int. Cl.
*E21B 7/06* (2006.01)
*E21B 17/10* (2006.01)
*E21B 34/10* (2006.01)

(52) U.S. Cl.
CPC ..... *E21B 7/068* (2013.01); *E21B 17/1021* (2013.01); *E21B 34/10* (2013.01)

(58) Field of Classification Search
CPC ..... E21B 7/068; E21B 17/021; E21B 34/10; E21B 7/06
See application file for complete search history.

(56) References Cited

U.S. PATENT DOCUMENTS 5,553,678 A * 9/1996 Barr ..... E21B 47/01 175/73
8,672,056 B2 * 3/2014 Clark ..... E21B 7/062 175/61

(Continued)

FOREIGN PATENT DOCUMENTS

WO 2017065724 A1 4/2017

OTHER PUBLICATIONS

International Search Report and Written Opinion dated Jan. 2, 2019, of PCT/US2018/018598, filed on Feb. 19, 2018.

(Continued)

*Primary Examiner* — Taras P Bemko
(74) *Attorney, Agent, or Firm* — K&L Gates LLP

(57) ABSTRACT

A rotary steerable tool for directional drilling includes a tool body including an outer surface and a flowbore therethrough, a pad movably coupled to the tool body and alternately movable between an extended position and a retracted position, and a piston engageable with the pad to move the pad. The tool further includes a pressurized fluid supply flow path to provide fluid pressure to the piston for the piston to controllably move the pad to the extended position, and a dump valve in fluid communication with the pressurized fluid supply flow path to selectively vent fluid pressure to allow the pad to move from the extended position toward the retracted position.

16 Claims, 10 Drawing Sheets

(56) References Cited

U.S. PATENT DOCUMENTS

| | | | | |
|---|---|---|---|---|
| 8,708,064 | B2 | 4/2014 | Downton et al. | |
| 8,869,916 | B2 * | 10/2014 | Clausen | E21B 7/06 175/61 |
| 2006/0243487 | A1 | 11/2006 | Turner et al. | |
| 2010/0006341 | A1 | 1/2010 | Downton | |
| 2011/0266063 | A1 | 11/2011 | Downton | |
| 2012/0048571 | A1 * | 3/2012 | Radford | E21B 23/04 166/373 |
| 2012/0160565 | A1 * | 6/2012 | Downton | E21B 7/062 175/61 |
| 2014/0014413 | A1 * | 1/2014 | Niina | E21B 21/10 175/61 |
| 2014/0169128 | A1 | 6/2014 | Orban et al. | |
| 2018/0252088 | A1 * | 9/2018 | Tilley | E21B 21/10 |
| 2018/0340374 | A1 * | 11/2018 | Moore | E21B 7/062 |

OTHER PUBLICATIONS

Extended European Search Report dated Aug. 5, 2021 for EP Application No. 18906076.7 dated Feb. 19, 2018. 6 pgs.

* cited by examiner

ROTARY STEERABLE TOOL WITH DUMP VALVE

BACKGROUND

This section is intended to provide relevant contextual information to facilitate a better understanding of the various aspects of the described embodiments. Accordingly, it should be understood that these statements are to be read in this light and not as admissions of prior art.

Directional drilling is commonly used to drill any type of well profile where active control of the well bore trajectory is required to achieve the intended well profile. For example, a directional drilling operation may be conducted when the target pay zone is not directly below or otherwise cannot be reached by drilling straight down from a drilling rig above it.

Directional drilling operations involve varying or controlling the direction of a downhole tool (e.g., a drill bit) in a borehole to direct the tool towards the desired target destination. Examples of directional drilling systems include point-the-bit rotary steerable drilling systems and push-the-bit rotary steerable drilling systems. In both systems, the drilling direction is changed by repositioning the bit position or angle with respect to the well bore. Push-the-bit tools use pads on the outside of the tool which press against the well bore thereby causing the bit to press on the opposite side causing a direction change. Point-the-bit technologies cause the direction of the bit to change relative to the rest of the tool.

Dogleg capability is the ability of a drilling system to make precise and sharp turns in forming a directional well. Higher doglegs increase reservoir exposure and allow improved utilization of well bores where there are lease line limitations. Tool face control is a fundamental factor of dogleg capability. Typically, a higher and more precise degree of tool face control increases dogleg capability. In some drilling systems, tool face is controlled by pads or pistons that extend from the drilling tool to push the drill bit in an opposing direction. In such system, a pad or piston is extended as it rolls into the appropriate position and retracted as the pad or piston rolls out of said position. In existing systems, the pads or pistons are generally only extendable or retractable at a fixed rate, thereby providing low resolution tool face control.

BRIEF DESCRIPTION OF THE DRAWINGS

Illustrative embodiments of the present disclosure are described in detail below with reference to the attached drawing figures, which are incorporated by reference herein and wherein.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

The present disclosure generally relates to oil and gas exploration and production, and more particularly to systems and methods for directional drilling, such as a rotary steerable system (RSS). The disclosure relates to one or more dump valves included within a rotary steerable tool for increased control of pads that extend from the rotary steerable tool, thereby increasing control over the force vectors applied to the borehole wall by the pads or pistons and more accurately directing a drill bit.

Oil and gas hydrocarbons are naturally occurring in some subterranean formations. A subterranean formation containing oil or gas may be referred to as a reservoir, in which a reservoir may be located under land or off shore. Reservoirs are typically located in the range of a few hundred feet (shallow reservoirs) to a few tens of thousands of feet (ultra-deep reservoirs). To produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open-hole or cased-hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

Figure 1:
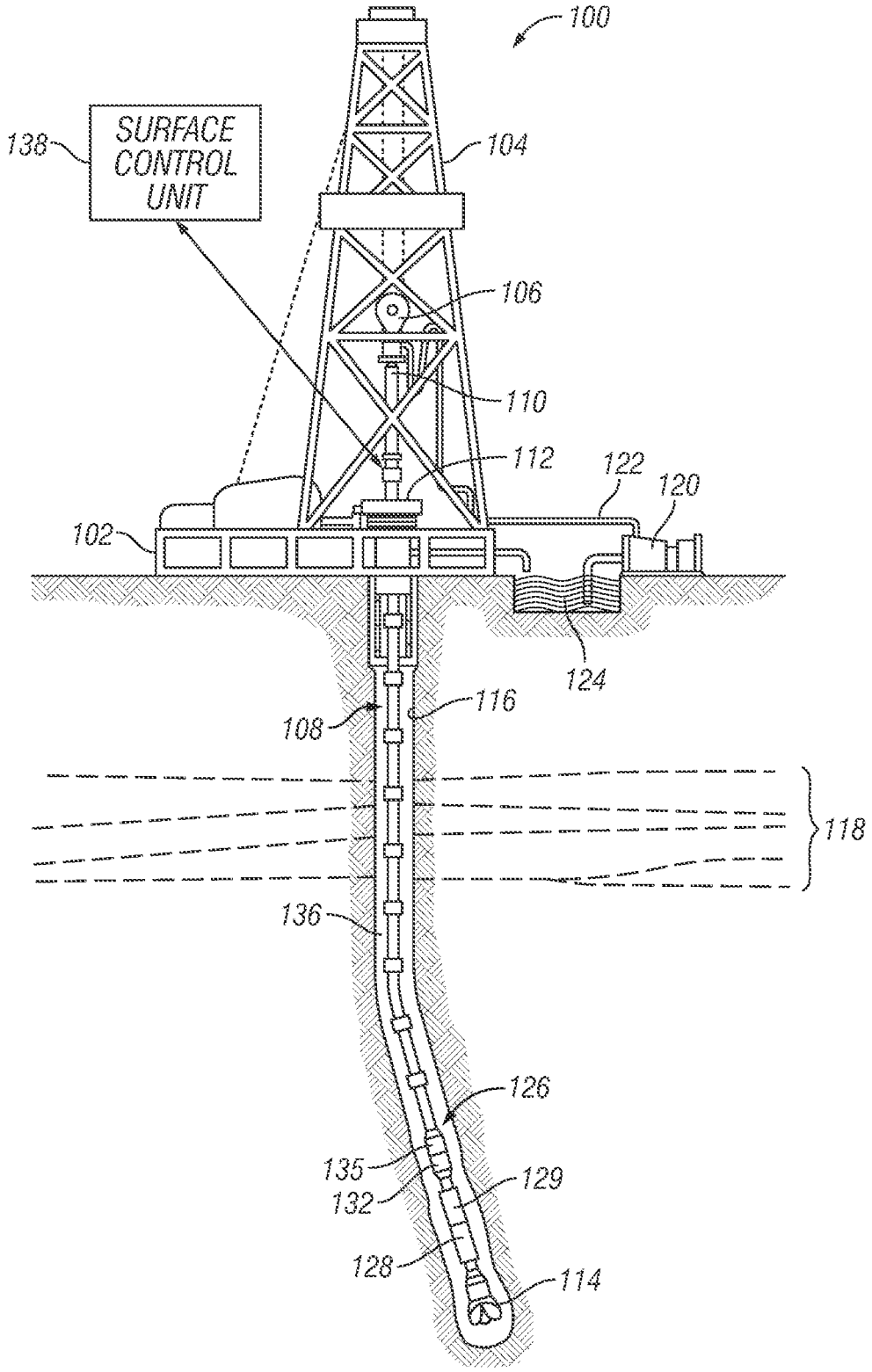
FIG. 1 shows schematic view of a well system in accordance with one or more embodiments of the present disclosure.

Turning now to the figures, FIG. 1 depicts a schematic view of a drilling operation utilizing a directional drilling system 100, in accordance with one or more embodiments. The system of the present disclosure will be specifically described below such that the system is used to direct a drill bit in drilling a borehole, such as a subsea well or a land well. Further, it will be understood that the present disclosure is not limited to only drilling an oil well. The present disclosure also encompasses natural gas boreholes, other hydrocarbon boreholes, or boreholes in general. Further, the present disclosure may be used for the exploration and formation of geothermal boreholes intended to provide a source of heat energy instead of hydrocarbons.

Accordingly, FIG. 1 shows a schematic view of a tool string 126 disposed in a directional borehole 116, in accordance with one or more embodiments. The tool string 126 includes a rotary steerable tool 128 in accordance with various embodiments. The rotary steerable tool 128 provides full 3D directional control of the drill bit 114. A drilling platform 102 supports a derrick 104 having a traveling block 106 for raising and lowering a drill string 108. A kelly 110 supports the drill string 108 as the drill string 108 is lowered through a rotary table 112. In one or more embodiments, a topdrive is used to rotate the drill string 108 in place of the kelly 110 and the rotary table 112. A drill bit 114 is positioned at the downhole end of the tool string 126, and, in one or more embodiments, may be driven by a downhole motor 129 positioned on the tool string 126 and/or by rotation of the entire drill string 108 from the surface.

As the bit 114 rotates, the bit 114 creates the borehole 116 that passes through various formations 118. A pump 120 circulates drilling fluid through a feed pipe 122 and downhole through the interior of drill string 108, through orifices in drill bit 114. The drilling fluid then flows back to the surface via the annulus 136 around drill string 108 and into a retention pit 124. The drilling fluid transports cuttings from the borehole 116 into the pit 124 and aids in maintaining the integrity of the borehole 116. The drilling fluid may also drive the downhole motor 129 and other portions of the rotary steerable tool 128, such as control pads for the tool 128.

The tool string 126 may include one or more logging while drilling (LWD) or measurement-while-drilling (MWD) tools 132 that collect measurements relating to various borehole and formation properties as well as the position of the bit 114 and various other drilling conditions as the bit 114 extends the borehole 108 through the formations 118. The LWD/MWD tool 132 may include a device for measuring formation resistivity, a gamma ray device for measuring formation gamma ray intensity, devices for measuring the inclination and azimuth of the tool string 126, pressure sensors for measuring drilling fluid pressure, temperature sensors for measuring borehole temperature, etc.

The tool string 126 may also include a telemetry module 135. The telemetry module 135 receives data provided by the various sensors of the tool string 126 (e.g., sensors of the LWD/MWD tool 132), and transmits the data to a surface unit 138. Data may also be provided by the surface unit 138, received by the telemetry module 135, and transmitted to the tools (e.g., LWD/MWD tool 132, rotary steering tool 128, etc.) of the tool string 126. In one or more embodiments, mud pulse telemetry, wired drill pipe, acoustic telemetry, or other telemetry technologies known in the art may be used to provide communication between the surface control unit 138 and the telemetry module 135. In one or more embodiments, the surface unit 138 may communicate directly with the LWD/MWD tool 132 and/or the rotary steering tool 128. The surface unit 138 may be a computer stationed at the well site, a portable electronic device, a remote computer, or distributed between multiple locations and devices. The unit 138 may also be a control unit that controls functions of the equipment of the tool string 126.

The rotary steerable tool 128 is configured to change the direction of the tool string 126 and/or the drill bit 114, such as based on information indicative of tool 128 orientation and a desired drilling direction or well profile. In one or more embodiments, the rotary steerable tool 128 is coupled to the drill bit 114 and drives rotation of the drill bit 114. Specifically, the rotary steerable tool 128 rotates in tandem with the drill bit 114. In one or more embodiments, the rotary steerable tool 128 is a point-the-bit system or a push-the-bit system.

Figure 2:
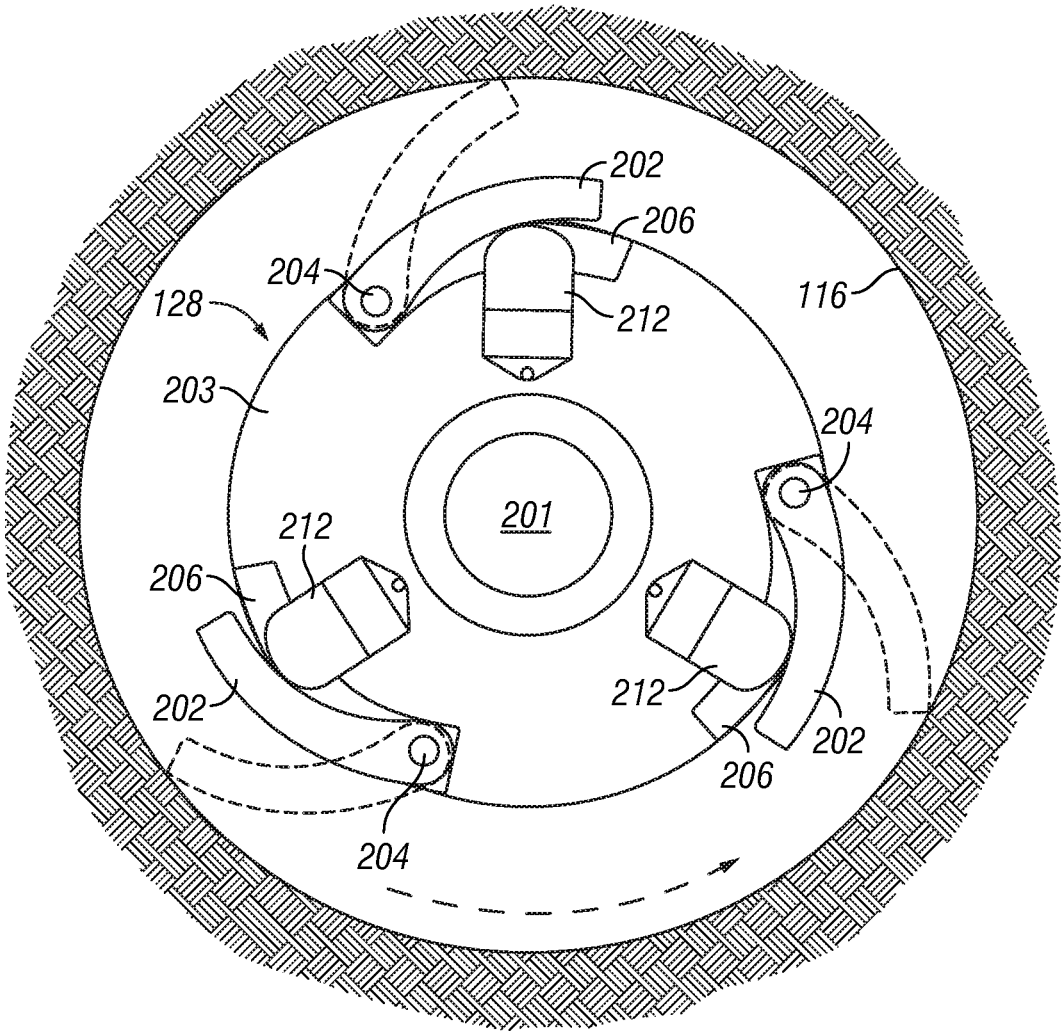
FIG. 2 shows a cross-sectional schematic view of a rotary steerable tool in accordance with one or more embodiments of the present disclosure.

FIG. 2 depicts a radial cross-sectional schematic view of the rotary steerable tool 128, showing the pads 202 (i.e., extendable members), in accordance with one or more embodiments of the present disclosure. The rotary steerable tool 128 includes a tool body 203 and a flowbore 201 through which drilling fluid flows. As shown, the pads 202 are close to the tool body 203 in a retracted position and movable outward into an extended position. In the illustrated example, the pads 202 are coupled to the tool body 203 and pivot between the retracted and extended positions, such as via hinges 204. The pads 202 can be extended and pushed outward and into the extended position by the pistons 212. In the illustrated embodiment, the tool body 203 includes recesses 206 which house the pads 202 when in the retracted position, thereby allowing the pads 202 to be flush with the tool body 203. Further, a piston 212 is engageable with each respective pad 202.

The pads 202 can be extended to varying degrees. The extended position can refer to any position in which the pad 202 is extended outwardly beyond the retracted position and not necessarily fully extended. "Retraction" or "retracting" refers to the act of bringing the pad 202 inward (e.g., radially inward), or moving the pad 202 from a more extended position to a less extended position, and does not necessarily refer to moving the pad 202 into a fully retracted position. Similarly, "extension" or "extending" refers to the act of moving the pad 202 outward, such as from a less extended position to a more extended position, and does not necessarily refer to moving the pad 202 into a fully extended position.

As shown, the rotary steerable tool 128 includes three pads spaced 120 degrees apart around the circumference of the tool 128. However, the rotary steerable tool 128 can have more or less than the three pads 202 shown. The pad 202 is just one configuration of an extendable member or mechanism designed to push against the wall of the borehole 116 to urge the drill bit 114 in a direction. The rotary steerable tool 128 may include various other types of extendable members or mechanisms, including but not limited to pistons configured to push against the borehole 116 directly or pads 202 configured to be acted on by drilling fluid direction without an intermediate piston.

The pads 202, or alternative extendable members or mechanism, may also include a retraction mechanism (e.g., a spring or other biasing mechanism) that moves the pads 202 back into the closed position. In some other embodiments, the pads 202 may be configured to fall back into the closed position when pressure applied by the drill fluid at the pads 202 drops. In some embodiments, the pads 202 are coupled to the pistons 212 and, thus, travel with the piston 212. In other embodiments, as shown in FIG. 2, the pistons 212 may engage the pads 202 to push the pads 202 outwards from the retracted position towards the extended position, with the pads 202 relying on engagement with the borehole wall, or a retraction mechanism, to move the pads 202 from the extended position towards the retracted position. In one or more embodiments, the pads 202 may also function as centralizers, in which all the pads 202 remain in the extended position, keeping the rotary steerable tool 128 centralized in the borehole 116.

Figure 3:
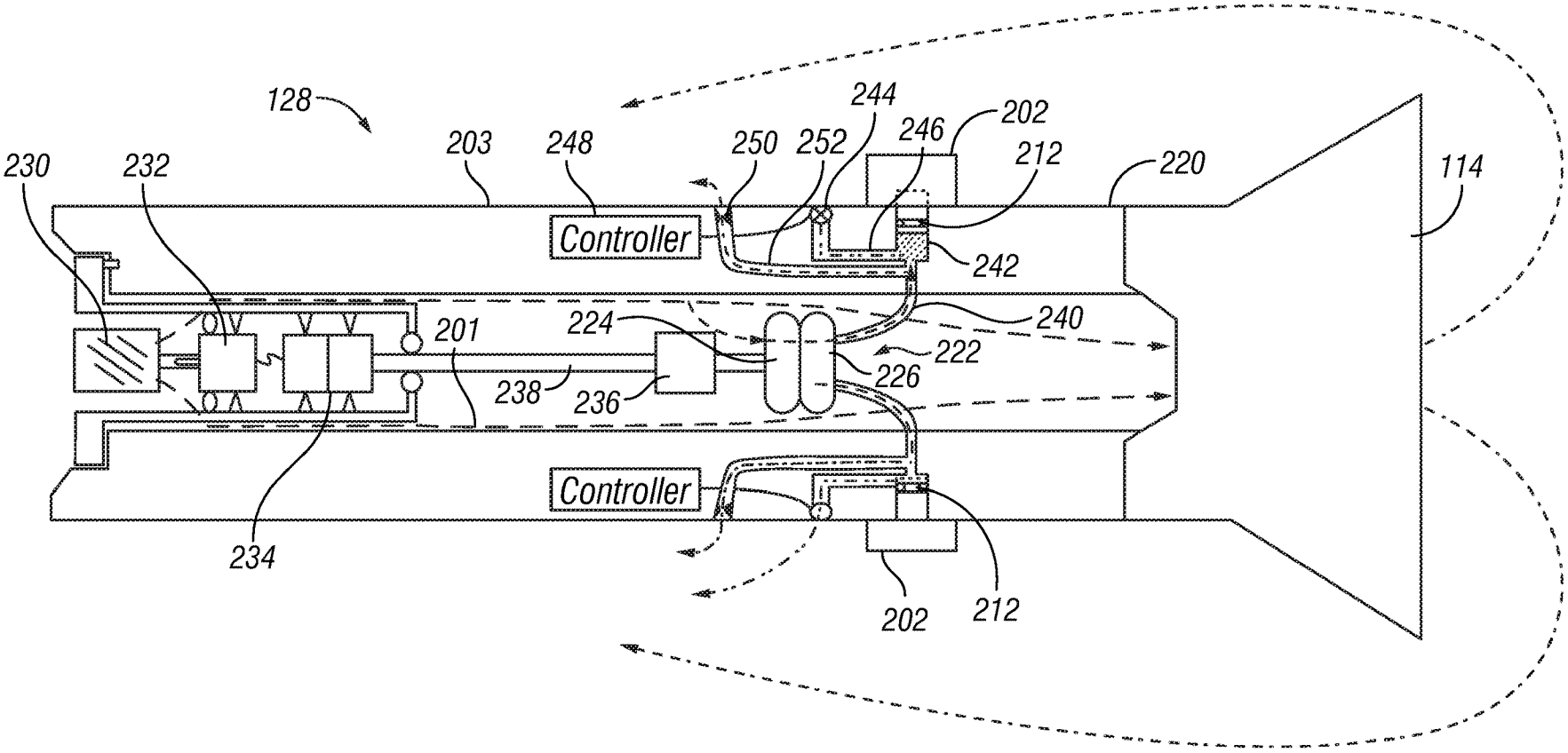
FIG. 3 shows a cross-sectional schematic view of a rotary steerable tool in accordance with one or more embodiments of the present disclosure.

Referring now to FIG. 3, a cross-sectional schematic view of a rotary steerable tool 128 in accordance with one or more embodiments of the present disclosure. The rotary steerable tool 128 includes a tool body 203 with a flowbore 201 formed through the tool body 203 for fluid flow and fluid pressure. A drill bit 114 is coupled to the tool body 203 for the tool 128 to control the orientation of the drill bit 114 when drilling. One or more pads 202 (i.e., extendable members) are coupled to the tool body 203 and alternately movable between an extended position and a retracted position with respect to an outer surface 220 of the tool body 203.

One or more pistons 212 are positioned within the tool body 203 and also movable between an extended position and a retracted position with respect to the tool body 203. Each of the pistons 212 is engageable with a respective one of the pads 202, such that, as the piston 212 moves from the retracted position to the extended position, the pad 202 in engagement with the respective piston 212 also moves from the retracted position to the extended position. Thus, when the piston 212 is in the extended position, the pad 202 is in the extended position. Further, if the piston 212 is coupled (e.g., connected) to the pad 202, when the piston 212 is in the retracted position, the pad 202 is in the retracted position.

As shown in this embodiment, a rotary valve 222 is used to control fluid pressure to move the pistons 212 and the pads 202 from the retracted position to the extended position. The rotary valve 222 includes an upper disk 224 and a lower disk 226 and is positioned within the tool body 203 of the rotary steerable tool 128. As the upper disk 224 rotates with respect to the lower disk 226, the rotary valve 222 selectively routes fluid pressure from the flowbore 201 to one or more of the pistons 212 through one or more respective pressurized fluid supply flow paths 240 to move the piston 212 and the pad 202 from the retracted position to the extended position.

To control the rotary valve 222, the rotary steerable tool 128 may include or be operably coupled to a turbine 230, a generator 232, a motor 234, and/or a controller 236 in this embodiment. For example, as shown, the turbine 230, the generator 232, the motor 234, and/or the controller 236 may be included within the tool body 203 of the tool 128. Alternatively, one or more of these components may be positioned outside of the tool body 203, such as included within another tool, and then operably coupled to the tool 128. In this embodiment, the turbine 230 receives fluid flow through the flowbore 201, and is coupled to the generator 232 for the generator 232 to produce power from the turbine 230. The generator 232 is then operably coupled to the motor 234 to provide power to the motor 234 to a drive shaft 238. The drive shaft 238 extends between the motor 234 and the controller 236 (e.g., gear box) for the controller 236 to control the rotary valve 222, such as by selectively moving the upper disk 224 with respect to the lower disk 226.

With respect to one of the pairs or sets of a piston 212 and a pad 202, the rotary valve 222 is used to route fluid pressure from the flowbore 201, through a pressurized fluid supply flow path 240 extending between the rotary valve 222 and the piston 212, and to a piston reservoir 242 housing or fluidly coupled to the piston 212. This arrangement enables the rotary valve 222 to selectively control fluid pressure from the flowbore 201 to the piston 212 to move the piston 212 and the pad 202 from the retracted position to the extended position.

Referring still to FIG. 3, though optional, one or more choke valves 250 may be included within the rotary steerable tool 128. A choke valve 250 may be in fluid communication with the pressurized fluid supply flow path 240 to be fluidly coupled between to the piston 212 and regulate fluid flow between the piston 212 and an exterior of the tool body 203. For example, when fluid pressure is provided to the piston 212 from the rotary valve 222, the choke valve 250 may regulate and restrict the fluid flow away from the piston 212 to the exterior of the tool body 203. With the choke valve 250 included within the tool 128, the choke valve 250 provides resistance to fluid flow, which creates fluid pressure, thereby enabling fluid pressure and fluid flow to accumulate within the piston reservoir 242 to move the piston 212 from the retracted position to the extended position. The choke valve 250 also provides a path for fluid pressure and fluid flow away from the piston reservoir 242, such as in the event of damage or failure to the piston 212 or pad 202. This may prevent the piston 212 or pad 202 from locking (e.g., hydraulically) for the piston 212 and pad 202 to still move from the extended position to the retracted position. As such, the choke valve 250 is shown as positioned within a choke valve flow path 252 extending between the piston reservoir 242 and the exterior of the tool body 203.

In accordance with one or more embodiments of the present disclosure, one or more dump valves 244 is included within the rotary steerable tool 128, such as to facilitate or increase the rate by which one or more of the pistons 212 and the pads 202 is able to move from the extended position to the retracted position. The dump valve 244 is in fluid communication with the pressurized fluid supply flow path 240 to be fluidly coupled to the piston 212 to control fluid flow between the piston 212 and an exterior of the tool body 203. When it is desired to move the piston 212 and the pad 202 from the extended position to the retracted position, the dump valve 244 opens to enable fluid pressure and fluid flow from the pressurized fluid supply flow path 240 and the piston reservoir 242 to the exterior of the tool body 203, thereby enabling the piston 212 and the pad 202 to move without restriction.

In this embodiment, a dump valve flow path 246 is formed in the tool body 203 to extend between the piston reservoir 242 and the exterior of the tool body 203. The dump valve 244 is positioned within the dump valve flow path 246 to selectively vent fluid pressure from the pressurized fluid supply flow path 240 to an exterior of the tool 128 through the dump valve 244. In an open position, the dump valve 244 enables or allows fluid pressure and fluid flow through the dump valve flow path 246, and in a closed position, the dump valve 244 prevents fluid pressure and fluid flow through the dump valve flow path 246. A controller 248 is operably coupled to the dump valve 244 to control the dump valve 244 between the open and closed positions, and an actuator is coupled to the dump valve 244 to move the dump valve 244 between the open and closed positions. The actuator to move the dump valve 244 may, for example, include a hydraulic actuator, an electromagnetic actuator, a piezoelectric actuator, or a mechanical drive actuator.

In one or more embodiments, the dump valve 244 may control fluid pressure and fluid flow therethrough based upon a position of the rotary valve 222. For example, the controller 248 for the dump valve 244 may monitor or receive a signal regarding the position of the rotary valve 222 (such as from the controller 236), in which the controller 248 may initiate an actuator to move the dump valve 244 to the open position or the closed position based upon the position of the upper disk 224 with respect to the lower disk 226 of the rotary valve 222. If the flow paths of the upper disk 224 and the lower disk 226 of the rotary valve 222 are aligned to provide fluid flow to a respective piston reservoir 242, the controller 248 may have the dump valve 244 in the closed position to enable fluid flow and pressure to move the piston 212 and the pad 202 to an extended position. If the flow paths of the upper disk 224 and the lower disk 226 of the rotary valve 222 are not aligned to not provide fluid flow to the respective piston reservoir 242, the controller 248 may have the dump valve 244 in the open position to enable vent fluid pressure and move the piston 212 and the pad 202 to a retracted position. The dump valve 244 in the open position enables fluid pressure to vent and flow out of the pressurized fluid supply flow path 240 and the piston reservoir 242 more quickly than, for example, through the choke valve 250. This enables the piston 212 and the pad 202 to move to the retracted position more quickly for better control of the drill bit 114.

Figure 4B:
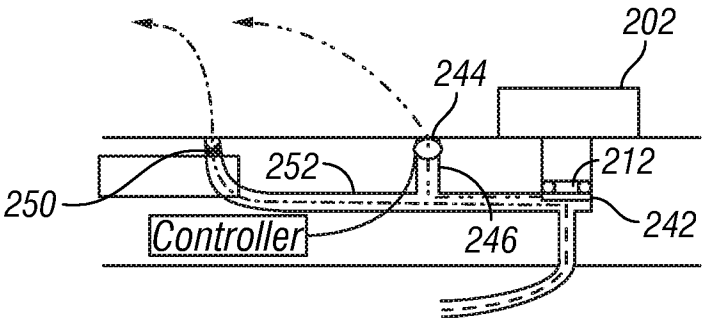
FIGS. 4A-4E show schematic views of a dump valve and a choke valve included in a rotary steerable tool in accordance with one or more embodiments of the present disclosure.
Figure 4D:
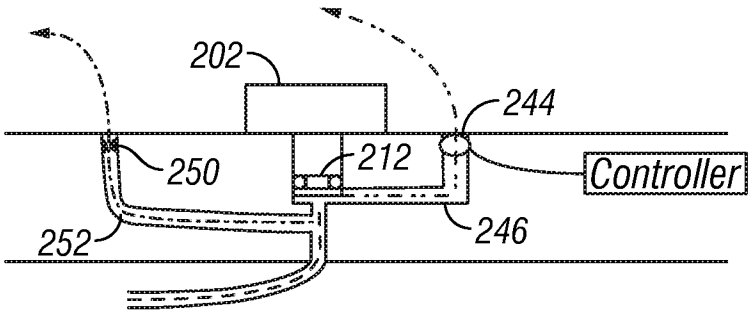
Figure 4A:
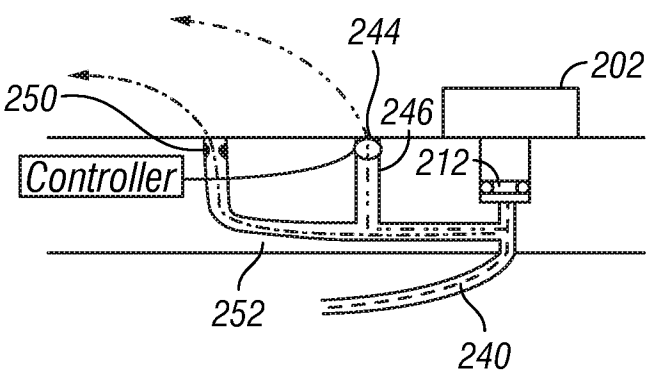
Figure 4C:
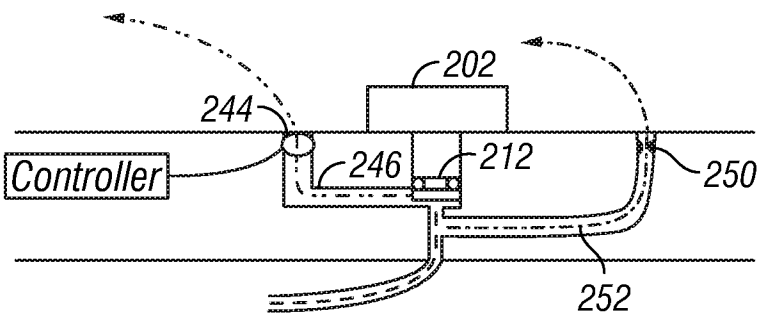
Figure 4E:
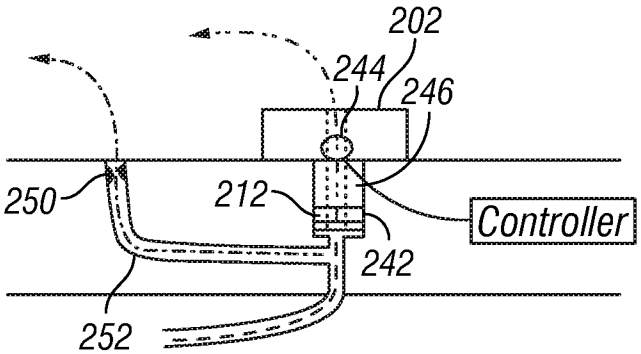

Referring now to FIGS. 4A-4E, multiple arrangements are shown for the dump valve 244 and the choke valve 250 with respect to the piston 212 and the pad 202 in accordance with one or more embodiments of the present disclosure. In each of FIGS. 4A-4E, the dump valve 244 is positioned in the dump valve flow path 246 and the choke valve 250 is positioned in the choke valve flow path 252. In FIG. 4A, the flow paths 246 and 252 partially overlap with each other with the flow paths 246 and 252 connected to and in fluid communication with the pressurized fluid supply flow path 240 extending between the rotary valve and the piston 212. In FIG. 4B, the flow paths 246 and 252 partially overlap with each other with the flow paths 246 and 252 connected to the piston reservoir 242. In FIGS. 4C and 4D, the flow paths 246 and 252 are independent of each other and are positioned on opposite sides of the piston 212 with respect to each other. FIG. 4C shows the opposite arrangement for the flow paths 246 and 252 with respect to FIG. 4D. Further, in FIG. 4E, the dump valve flow path 246 may be formed through the piston 212 and/or the pad 202 with the dump valve 244 positioned therein, enabling fluid to flow from the piston reservoir 242, through the piston 212, the pad 202, the dump valve 244, and to the exterior of the rotary steerable tool.

Figure 5B:
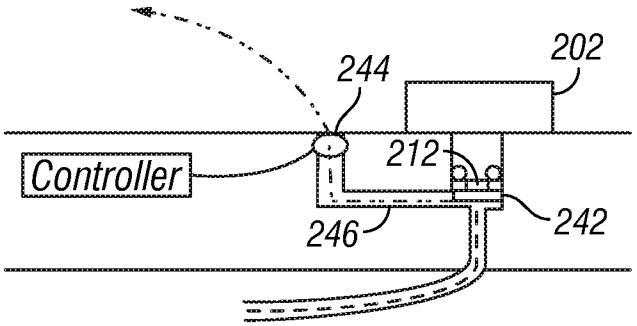
FIGS. 5A and 5B show schematic views of a dump valve included in a rotary steerable tool in accordance with one or more embodiments of the present disclosure.
Figure 5A:
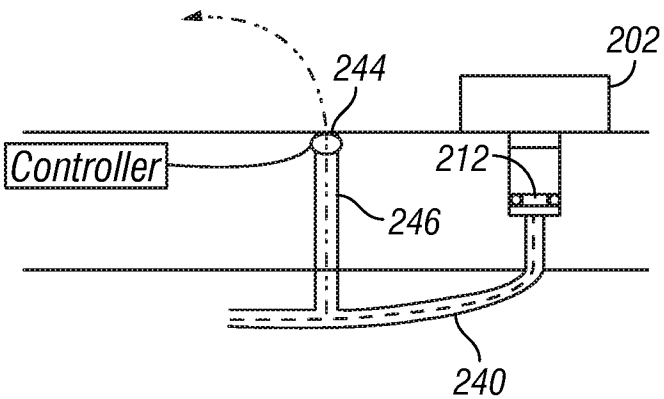

In one or more embodiments, a choke valve 250 may not be included within a rotary steerable tool 128, in which the dump valve 244 may be solely relied upon to enable fluid pressure and fluid flow away from the piston 212 to the exterior of the tool 128. FIGS. 5A and 5B show arrangements in which only a dump valve 244, and not a choke valve 250, is included with a rotary steerable tool 128. In FIG. 5A, the dump valve flow path 246 connects to and is in fluid communication with the pressurized fluid supply flow path 240, and in FIG. 5B, the dump valve flow path 246 is in fluid communication with the pressurized fluid supply flow path 240 though the piston reservoir 242.

Figure 6:
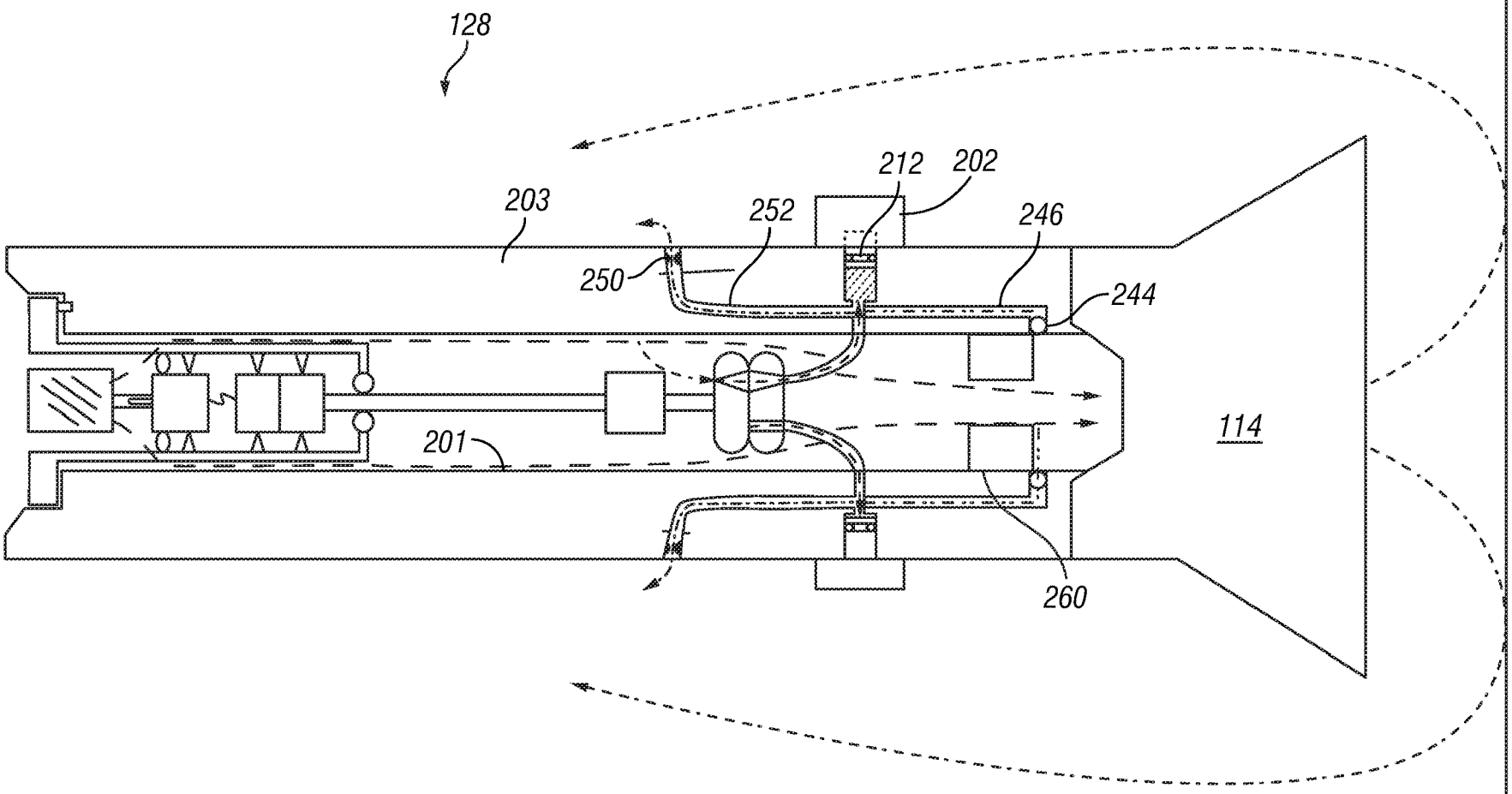
FIG. 6 shows a cross-sectional schematic view of a rotary steerable tool in accordance with one or more embodiments of the present disclosure.

As discussed above, a dump valve 244 and/or a choke valve 250 may be used to selectively control fluid pressure from a pressurized fluid supply flow path 240 and a piston 212 to an exterior of the tool body 203. In FIG. 3, the dump valve flow path 246 and the choke valve flow path 252 are formed such that fluid pressure would flow away from the piston 212 and to the outer surface 220 of the tool body 203. However, the present disclosure is not so limited, as the dump valve flow path 246 and the choke valve flow path 252 may be formed such that fluid may flow to the flowbore 201 formed through the tool body 203 instead to the outer surface 220. For example, in FIG. 6, the dump valve flow path 246 may extend between the piston 212 and the flowbore 201 to control fluid flow therethrough. Similarly, though not shown here, the choke valve flow path 252 may extend between the piston 212 and the flowbore 201. In such an embodiment, a flow restrictor 260 or orifice may be positioned or formed within the flowbore 201 of the tool 128. An outlet for the dump valve flow path 246 is formed within the flowbore 201 downstream of the flow restrictor 260 to decrease the fluid pressure at the location of the outlet and enable fluid flow through the dump valve flow path 246.

Figure 7A:
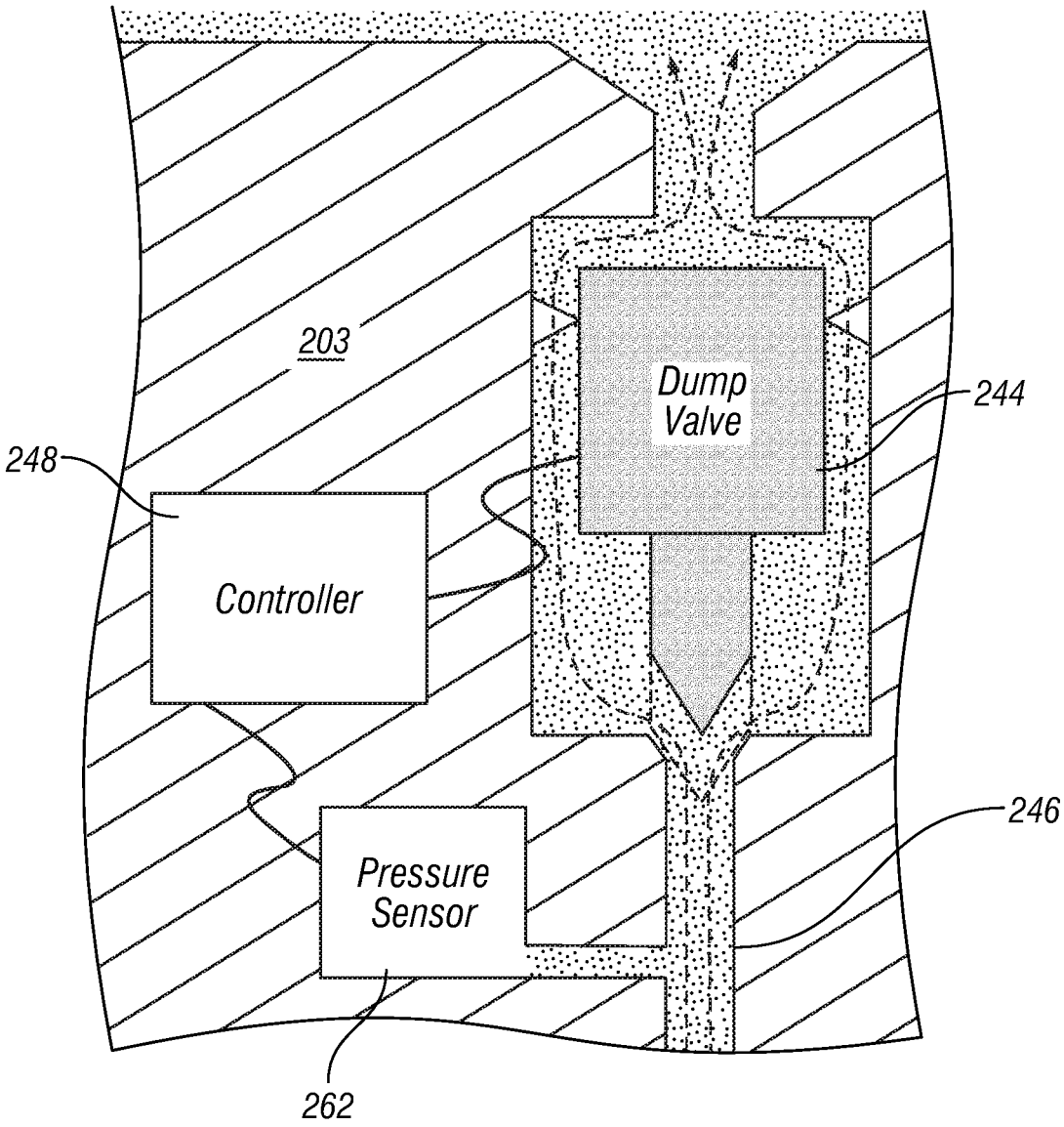
FIGS. 7A and 7B show schematic views of a dump valve and a sensor included in a rotary steerable tool in accordance with one or more embodiments of the present disclosure.
Figure 7B:
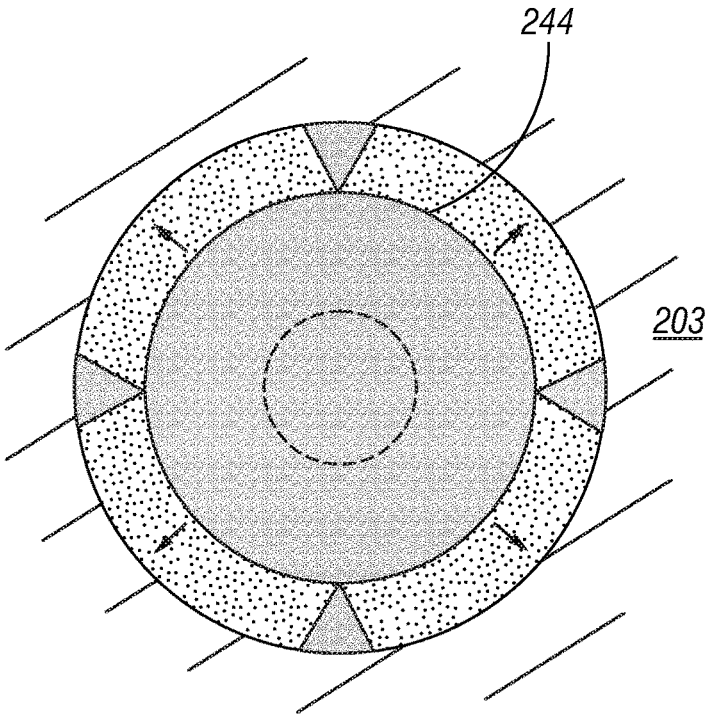

In one or more embodiments, a sensor may be included with the rotary steerable tool 128 with the dump valve 244 controlled based upon the output of the sensor. For example, FIGS. 7A and 7B show multiple views of a dump valve 244 included within a dump valve flow path 246 of a tool body 203. A controller 248 for controlling the dump valve 244 is positioned within the tool body 203, along with a sensor 262. In this embodiment, the sensor 262 may be a pressure sensor with the sensor 262 fluidly coupled to the dump valve flow path 246. The sensor 262 may measure a characteristic or property of the fluid (e.g., pressure in this example), in which the controller 248 is operably coupled to the sensor 262 to receive the measurement from the sensor 262. The controller 248 may compare the measurement from the sensor 262 with a predetermined value, or based upon a predetermined amount of time, and then move the dump valve 244 to the open position or the closed position based upon the comparison. For instance, if a pressure measured by the sensor 262 is above a predetermined amount, or if the dump valve 244 has been exposed to fluid pressure above a predetermined amount of time, the controller 248 may open the dump valve 244 for fluid pressure to flow to the exterior of the tool 128 and into an annulus within the borehole.

Figure 8A:
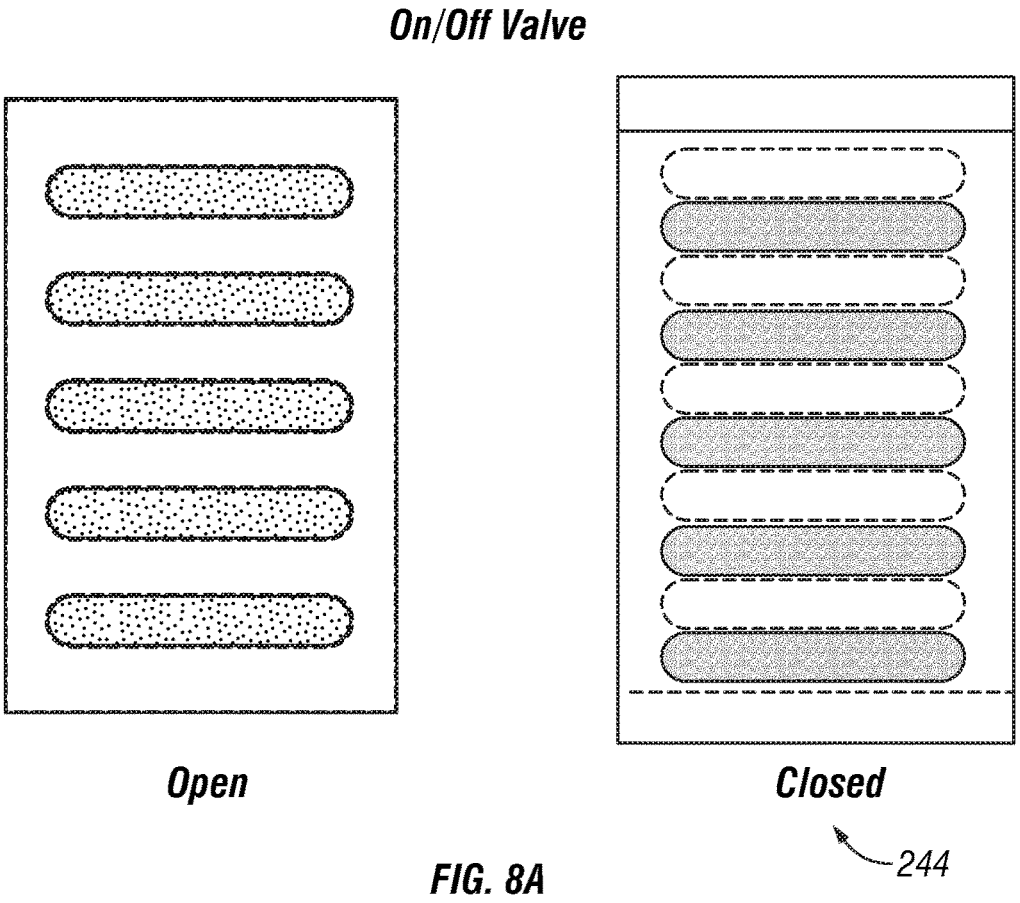
FIGS. 8A-8C show schematic views of a dump valve in accordance with one or more embodiments of the present disclosure.
Figure 8B:
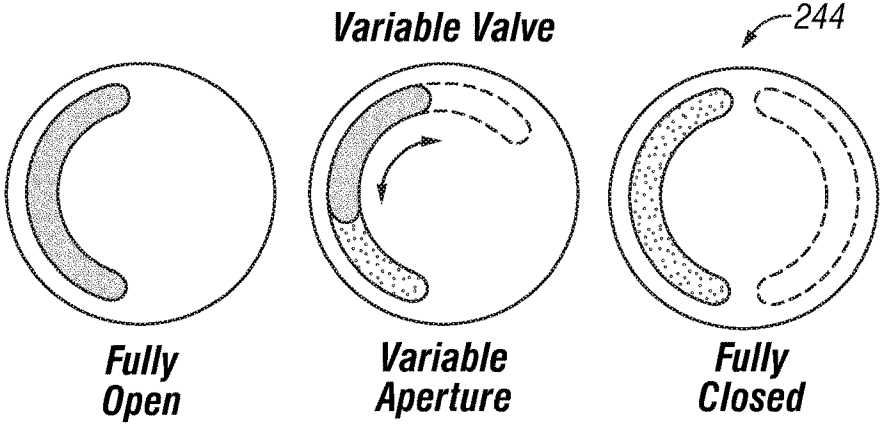
Figure 8C:
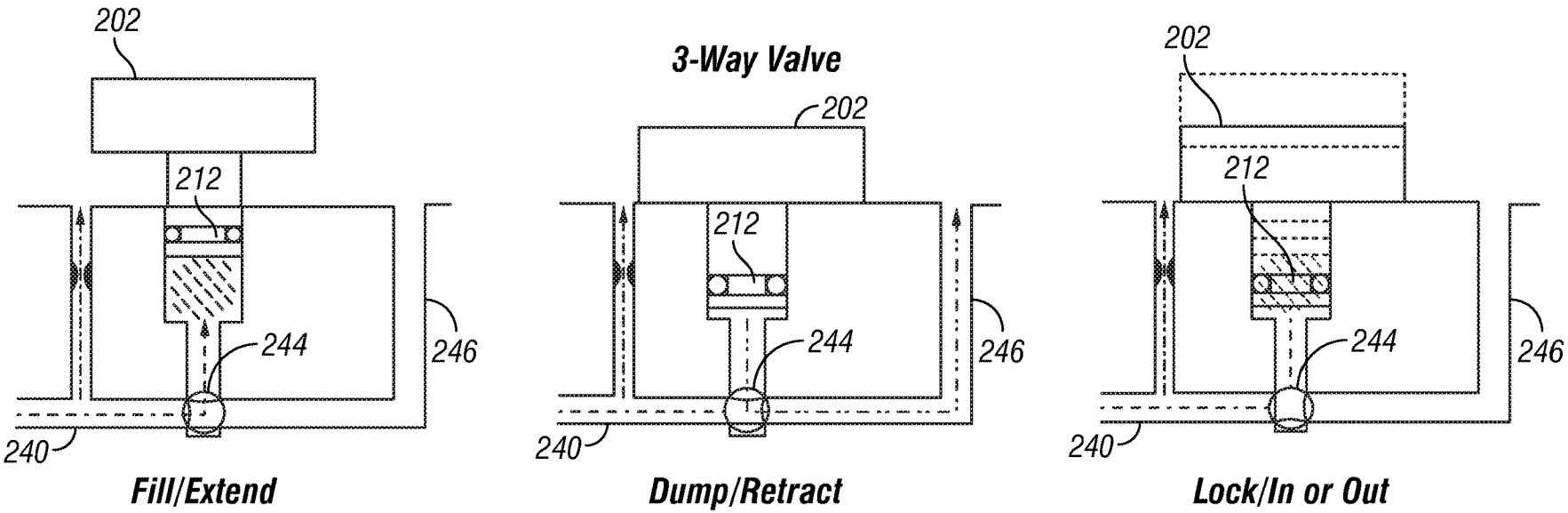

A dump valve in accordance with one or more embodiments of the present disclosure may include one or more different types of valves. For example, a dump valve 244 may include an on/off valve, such as shown in FIG. 8A, may include a variable valve, such as shown in FIG. 8B, or may include a three-way valve, such as shown in FIG. 8C. If the dump valve 244 is a three-way valve, the dump valve 244 may be fluidly coupled between pressurized fluid supply flow path 240, the piston reservoir 242, and the dump valve flow path 246. In a first position, the dump valve 244 may route fluid pressure to the piston 212 and the pad 202 to move to the extended position. In a second position, the dump valve 244 may route fluid flow away from the piston 212 and the pad 202 to move to the retracted position. In a third position, the dump valve 244 may be used to hydraulically lock the piston 212 and the pad 202 in place, thereby preventing movement of the piston 212 and the pad 202. In one or more embodiments, a dump valve in accordance with the present disclosure may include a poppet valve, a rotating disk shear valve, a sliding plate shear valve, a spool valve, a gate valve, a ball valve, a diaphragm valve, or a butterfly valve.

Figure 9:
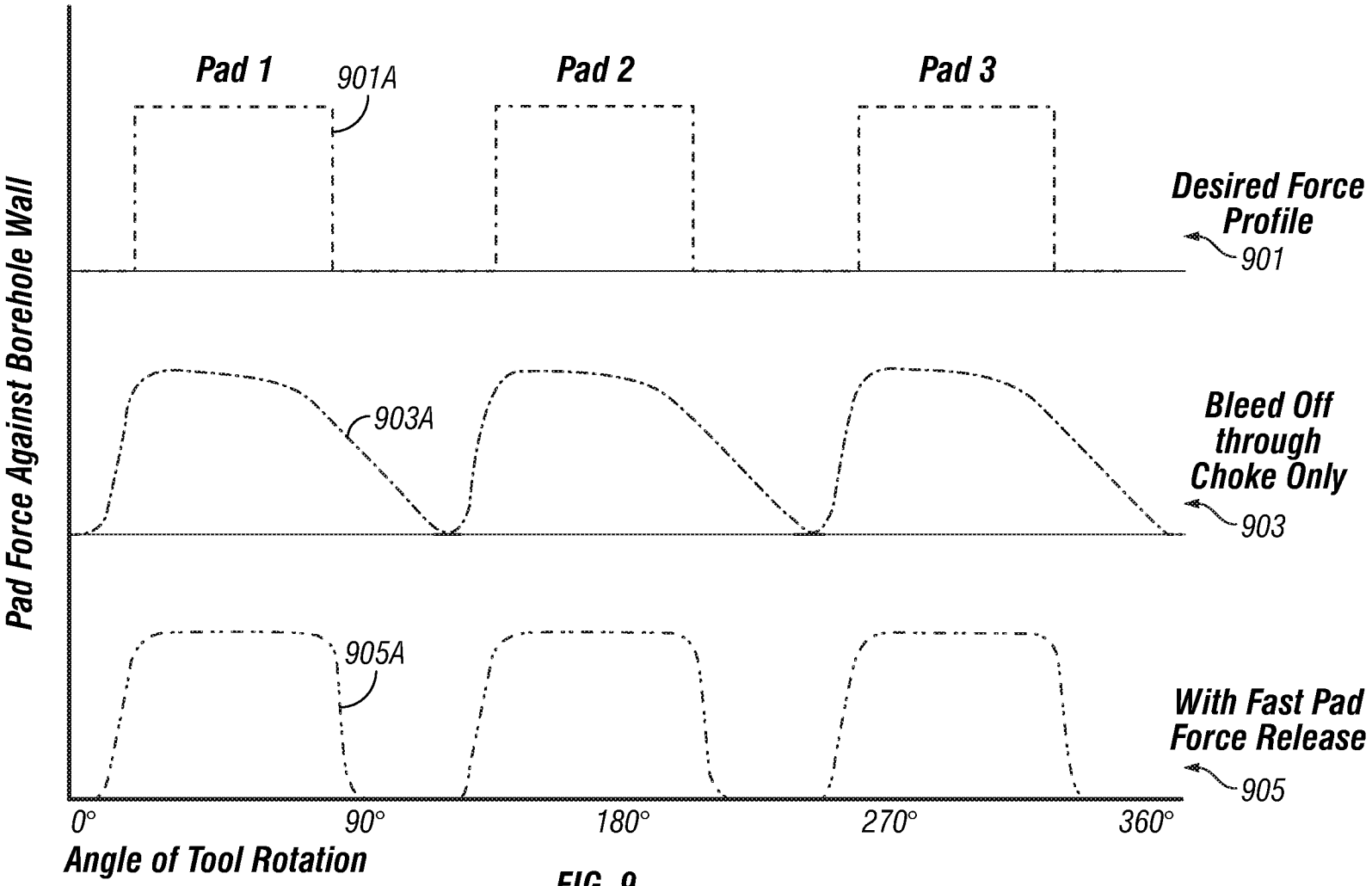
FIG. 9 shows a graph of various force profiles of pads within various rotary steerable tools in accordance with one or more embodiments of the present disclosure.

Referring now to FIG. 9, a graph in accordance with one or more embodiments of the present disclosure is shown. In FIG. 9, the x-axis represents the angle of rotation of a rotary steerable tool within a borehole, and the y-axis represents the amount of force a pad exerts against the wall of a borehole for directional steering or drilling. Further, three profiles are shown, an upper profile 901, a middle profile 903, and a lower profile 905. The upper profile 901 shows a desired force profile for three pads used on a rotary steerable tool. As shown in the upper profile 901, it is desired for a pad to move from the retracted position to the extended position without any delay (e.g., vertical force profile), and move from the extended position to the retracted position without any delay (e.g., vertical force profile 901A). This enables more control when moving the pads for steering the rotary steerable tool within a borehole.

The middle profile 903 shows the force profile for three pads in a rotary steerable tool that only includes a choke valve and no dump valve. In such an embodiment, a pad is able to move from the retracted position to the extended position without much delay (e.g., almost vertical force profile), but the choke valve prevents the pad from being able to move from the extended position to the retracted position without undue delay (e.g., a slanted profile force profile 903A is shown). This slower movement of the pad from the extended position to the retracted position prevents full control for steering a rotary steerable tool, particularly if the tool is rotating at a faster speed within the borehole.

The lower profile 905 shows the force profile for three pads in a rotary steerable tool that only includes a dump valve, such as shown and discussed above. In such an embodiment, a pad is able to move from the retracted position to the extended position without much delay (e.g., almost vertical force profile), and is also able to move from the extended position to the retracted position without much delay (e.g., almost vertical force profile 905A). This quicker movement of the pad from the extended position to the retracted position enables better control for steering a rotary steerable tool, such as with respect to the middle profile 903, particularly when used at higher rotational speeds. Thus, a rotary steerable tool in accordance with the present disclosure may reduce the flow restriction and decrease the time duration needed when moving a piston and a pad from the extended position to the retracted position. This may reduce the erosion resistance that may otherwise damage components within the rotary steerable tool and may increase the speed at which the rotary steerable tool may operate.

In addition to the embodiments described above, many examples of specific combinations are within the scope of the disclosure, some of which are detailed below:

Embodiment 1. A rotary steerable tool for directional drilling, comprising:

- a tool body including an outer surface and a flowbore therethrough;
- a pad movably coupled to the tool body and alternately movable between an extended position and a retracted position;
- a piston engageable with the pad to move the pad;
- a pressurized fluid supply flow path to provide fluid pressure to the piston for the piston to controllably move the pad to the extended position; and
- a dump valve in fluid communication with the pressurized fluid supply flow path to selectively vent fluid pressure to allow the pad to move from the extended position toward the retracted position.

Embodiment 2. The tool of Embodiment 1, wherein the piston is coupled to the pad such that the piston moves with the pad from the extended position to the retracted position.

Embodiment 3. The tool of Embodiment 1, wherein the dump valve selectively vents fluid pressure from the pressurized fluid supply flow path to out of the tool body.

Embodiment 4. The tool of Embodiment 3, wherein the dump valve selectively vents fluid pressure to the outer surface of the tool body.

Embodiment 5. The tool of Embodiment 3, wherein the dump valve selectively vents fluid pressure to the flowbore.

Embodiment 6. The tool of Embodiment 1, further comprising a rotary valve in fluid communication with the pressurized fluid supply flow path to selectively control fluid pressure from the flowbore of the tool body to the piston for controllably moving the pad to the extended position.

Embodiment 7. The tool of Embodiment 6, wherein the dump valve selectively vents fluid pressure based upon a position of the rotary valve.

Embodiment 8. The tool of Embodiment 1, further comprising a sensor operably coupled to the dump valve, wherein the dump valve selectively vents fluid pressure based upon a measurement of the sensor.

Embodiment 9. The tool of Embodiment 1, further comprising a choke valve in fluid communication with the pressurized fluid supply flow path to regulate fluid pressure from the pressurized fluid supply flow path to out of the tool body.

Embodiment 10. The tool of Embodiment 1, further comprising a drill bit coupled to the tool body such that an orientation of the drill bit is controlled by the pad.

Embodiment 11. The tool of Embodiment 1, further comprising more than one pad and more than one piston, wherein each piston is engageable with a respective pad for moving the respective pad.

Embodiment 12. The tool of Embodiment 11, further comprising more than one dump valve, each dump valve corresponding to a pad and each being in fluid communication with the pressurized fluid supply flow path to selectively vent fluid pressure to allow the respective pad to move from the extended position toward the retracted position.

Embodiment 13. A method of directionally drilling a borehole, comprising:

- rotating a tool within the borehole, the tool comprising a pad, a piston engageable with the pad, and a dump valve fluidly coupled to the piston;
- moving the pad from a retracted position to an extended position by providing fluid pressure to the piston through a pressurized fluid supply flow path, thereby selectively applying a force against the borehole with the pad to push the tool in a direction; and
- controlling the dump valve to vent the fluid pressure from the pressurized fluid supply flow path to allow the pad to move from the extended position to the retracted position.

Embodiment 14. The method of Embodiment 13, wherein the moving the pad from the retracted position to the extended position comprises controlling fluid pressure through the pressurized fluid supply flow path with a rotary valve positioned in a flowbore of the tool to the piston.

Embodiment 15. The method of Embodiment 14, wherein the moving the pad from the retracted position to the extended position comprises controlling the dump valve based upon a position of the rotary valve.

Embodiment 16. The method of Embodiment 13, further comprising regulating fluid pressure flow from the pressurized fluid supply flow path to out of the tool with a choke valve.

Embodiment 17. The method of Embodiment 13, wherein the dump valve vents fluid pressure to an outer surface of the tool or a flowbore of the tool.

Embodiment 18. The method of Embodiment 13, further comprising drilling the borehole in the direction with a drill bit coupled to the tool.

Embodiment 19. A rotary steerable system for directional drilling, comprising:

a tool body including an outer surface and a flowbore therethrough;

a pad movably coupled to the tool body and alternately movable between an extended position and a retracted position;

a piston engageable with the pad to move the pad;

a pressurized fluid supply flow path to provide fluid pressure to the piston for the piston to controllably move the pad to the extended position;

a rotary valve in fluid communication with the pressurized fluid supply flow path to selectively control fluid pressure flow from the flowbore of the tool body to the piston for controllably moving the piston to the extended position;

a dump valve in fluid communication with the pressurized fluid supply flow path to selectively vent fluid pressure based upon a position of the rotary valve to allow the pad to move from the extended position toward the retracted position;

a choke valve in fluid communication with the pressurized fluid supply flow path to regulate fluid pressure from the pressurized fluid supply flow path to out of the tool body; and a drill bit coupled to the tool body such that an orientation of the drill bit is controllable by the pad.

Embodiment 20. The system of Embodiment 19, wherein:

the piston is coupled to the pad such that the piston moves with the pad from the extended position to the retracted position; and the dump valve selectively vents fluid pressure from the pressurized fluid supply flow path to the outer surface or the flowbore.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A rotary steerable tool for directional drilling, comprising:

a tool body including an outer surface and a flowbore therethrough;

a pad movably coupled to the tool body and alternately movable between an extended position and a retracted position;

a piston engageable with the pad to move the pad;

a pressurized fluid supply flow path to provide fluid pressure to the piston for the piston to controllably move the pad to the extended position;

a rotary valve in fluid communication with the pressurized fluid supply flow path to selectively control fluid pressure from the flowbore of the tool body to the piston for controllably moving the pad to the extended position; and a dump valve separate from the rotary valve and in fluid communication with the pressurized fluid supply flow path to selectively vent fluid pressure based upon a position of the rotary valve to allow the pad to move from the extended position toward the retracted position.

2. The tool of claim 1, wherein the piston is coupled to the pad such that the piston moves with the pad from the extended position to the retracted position.

3. The tool of claim 1, wherein the dump valve selectively vents fluid pressure from the pressurized fluid supply flow path to out of the tool body.

4. The tool of claim 3, wherein the dump valve selectively vents fluid pressure to the outer surface of the tool body.

5. The tool of claim 3, wherein the dump valve selectively vents fluid pressure to the flowbore.

6. The tool of claim 1, further comprising a sensor operably coupled to the dump valve, wherein the dump valve selectively vents fluid pressure based upon a measurement of the sensor.

7. The tool of claim 1, further comprising a choke valve in fluid communication with the pressurized fluid supply flow path to regulate fluid pressure from the pressurized fluid supply flow path to out of the tool body.

8. The tool of claim 1, further comprising a drill bit coupled to the tool body such that an orientation of the drill bit is controlled by the pad.

9. The tool of claim 1, further comprising more than one pad and more than one piston, wherein each piston is engageable with a respective pad for moving the respective pad.

10. The tool of claim 9, further comprising more than one dump valve, each dump valve corresponding to a pad and each being in fluid communication with the pressurized fluid supply flow path to selectively vent fluid pressure to allow the respective pad to move from the extended position toward the retracted position.

11. A method of directionally drilling a borehole, comprising:

rotating a tool within the borehole, the tool comprising a pad, a piston engageable with the pad, a rotary valve fluidly coupled to the piston, and a dump valve fluidly coupled to the piston and separate from the rotary valve;

controlling the rotary valve to provide fluid pressure to the piston through a pressurized fluid supply flow path, thereby moving the pad from a retracted position to an extended position to selectively apply a force against the borehole with the pad to push the tool in a direction; and controlling the dump valve to vent the fluid pressure from the pressurized fluid supply flow path based upon a position of the rotary valve and to allow the pad to move from the extended position to the retracted position.

12. The method of claim 11, further comprising regulating fluid pressure flow from the pressurized fluid supply flow path to out of the tool with a choke valve.

13. The method of claim 11, wherein the dump valve vents fluid pressure to an outer surface of the tool or a flowbore of the tool.

14. The method of claim 11, further comprising drilling the borehole in the direction with a drill bit coupled to the tool.

15. A rotary steerable system for directional drilling, comprising:

a tool body including an outer surface and a flowbore therethrough;

a pad movably coupled to the tool body and alternately movable between an extended position and a retracted position;

a piston engageable with the pad to move the pad;

a pressurized fluid supply flow path to provide fluid pressure to the piston for the piston to controllably move the pad to the extended position;

a rotary valve in fluid communication with the pressurized fluid supply flow path to selectively control fluid pressure flow from the flowbore of the tool body to the piston for controllably moving the piston to the extended position;

a dump valve in fluid communication with the pressurized fluid supply flow path to selectively vent fluid pressure based upon a position of the rotary valve to allow the pad to move from the extended position toward the retracted position;

a choke valve in fluid communication with the pressurized fluid supply flow path to regulate fluid pressure from the pressurized fluid supply flow path to out of the tool body; and a drill bit coupled to the tool body such that an orientation of the drill bit is controllable by the pad.

16. The system of claim 15, wherein:

the piston is coupled to the pad such that the piston moves with the pad from the extended position to the retracted position; and the dump valve selectively vents fluid pressure from the pressurized fluid supply flow path to the outer surface or the flowbore.

* * * * *